US010014107B2

(12) United States Patent
Ozeki et al.

(10) Patent No.: US 10,014,107 B2
(45) Date of Patent: Jul. 3, 2018

(54) RARE-EARTH PERMANENT MAGNET, METHOD FOR MANUFACTURING RARE-EARTH PERMANENT MAGNET AND SYSTEM FOR MANUFACTURING RARE-EARTH PERMANENT MAGNET

(71) Applicant: NITTO DENKO CORPORATION, Ibaraki-shi, Osaka (JP)

(72) Inventors: Izumi Ozeki, Ibaraki (JP); Katsuya Kume, Ibaraki (JP); Toshiaki Okuno, Ibaraki (JP); Tomohiro Omure, Ibaraki (JP); Takashi Ozaki, Ibaraki (JP); Keisuke Taihaku, Ibaraki (JP); Takashi Yamamoto, Ibaraki (JP)

(73) Assignee: NITTO DENKO CORPORATION, Ibaraki-shi, Osaka (JP)

( * ) Notice: Subject to any disclaimer, the term of this patent is extended or adjusted under 35 U.S.C. 154(b) by 796 days.

(21) Appl. No.: 14/384,183

(22) PCT Filed: Mar. 8, 2013

(86) PCT No.: PCT/JP2013/056434
§ 371 (c)(1),
(2) Date: Sep. 10, 2014

(87) PCT Pub. No.: WO2013/137135
PCT Pub. Date: Sep. 19, 2013

(65) Prior Publication Data

US 2015/0084727 A1 Mar. 26, 2015

(30) Foreign Application Priority Data

Mar. 12, 2012 (JP) ..... 2012-054687

(51) Int. Cl.
*B22F 3/105* (2006.01)
*H01F 41/02* (2006.01)
(Continued)

(52) U.S. Cl.
CPC ..... *H01F 41/0266* (2013.01); *B22F 3/105* (2013.01); *B22F 3/14* (2013.01);
(Continued)

(58) Field of Classification Search
None
See application file for complete search history.

(56) References Cited

U.S. PATENT DOCUMENTS 6,155,028 A 12/2000 Nagata et al.
6,331,214 B1 * 12/2001 Koga ..... B23K 20/021 148/101
(Continued)

FOREIGN PATENT DOCUMENTS

CN 102007555 A 4/2011
EP 1 788 594 A1 5/2007
(Continued)

OTHER PUBLICATIONS

Notification of the First Office Action dated Feb. 1, 2016, from the State Intellectual Property Office of People's Republic of China in counterpart application No. 201380014100.3.
(Continued)

*Primary Examiner* — Jessee R Roe
*Assistant Examiner* — Ngoclan T Mai
(74) *Attorney, Agent, or Firm* — Sughrue Mion, PLLC

(57) ABSTRACT

There are provided a rare-earth permanent magnet, and a method for manufacturing a rare-earth permanent magnet and a system for manufacturing a rare-earth permanent magnet, capable of achieving improved shape uniformity. Magnet material is milled into magnet powder, and the milled magnet powder is formed into a formed body 40. The formed body 40 is calcined and then sintered using a spark plasma sintering apparatus 45, so that a permanent magnet 1 is manufactured. A die unit 46 included in the spark plasma
(Continued)

sintering apparatus 45 that performs spark plasma sintering at least includes in one direction an inflow hole 50 configured to receive inflow of part of the pressurized formed body.

6 Claims, 9 Drawing Sheets

(51) Int. Cl.

| | |
|---|---|
| ***C22C 38/00*** | (2006.01) |
| ***H01F 1/057*** | (2006.01) |
| ***H01F 1/08*** | (2006.01) |
| ***H01F 7/02*** | (2006.01) |
| ***B22F 3/14*** | (2006.01) |

(52) U.S. Cl.

CPC ..... *C22C 38/00* (2013.01); *C22C 38/002* (2013.01); *C22C 38/005* (2013.01); *H01F 1/0577* (2013.01); *H01F 1/086* (2013.01); *H01F 7/02* (2013.01); *B22F 2003/1051* (2013.01); *B22F 2301/355* (2013.01); *B22F 2998/10* (2013.01); *B22F 2999/00* (2013.01)

(56) References Cited

U.S. PATENT DOCUMENTS

| | | | | |
|---|---|---|---|---|
| 2007/0245851 | A1* | 10/2007 | Sagawa | B22F 3/1021 75/10.67 |
| 2009/0123774 | A1* | 5/2009 | Nishiuchi | H01F 1/0573 428/566 |
| 2011/0037548 | A1 | 2/2011 | Ozeki et al. | |
| 2012/0091832 | A1* | 4/2012 | Soderberg | C08J 3/00 310/44 |
| 2012/0182104 | A1 | 7/2012 | Ozeki et al. | |
| 2013/0343946 | A1 | 12/2013 | Sagawa et al. | |

FOREIGN PATENT DOCUMENTS

| | | | |
|---|---|---|---|
| EP | 2 273 515 | A1 | 1/2011 |
| JP | 2-266503 | A | 10/1990 |
| JP | 7-99129 | A | 4/1995 |
| JP | 8-88133 | A | 4/1996 |
| JP | 11-90694 | A | 4/1999 |
| JP | 2008-263242 | A | 10/2008 |
| JP | 2011-228662 | A | 11/2011 |
| KR | 10-2007-0043782 | A | 4/2007 |
| KR | 10-2010-0136508 | A | 12/2010 |
| WO | 2011/125593 | A1 | 2/2015 |

OTHER PUBLICATIONS

Notification of the First Office Action dated Nov. 4, 2016, from the Intellectual Property Office of Taiwan in counterpart application No. 102108729.

Extended European Search Report dated Feb. 11, 2015, issued by the European Patent Office in counterpart European application No. 13761202.4.

International Search Report for PCT/JP2013/056434 dated Jul. 2, 2013.

Notification of Reasons for Rejection dated Aug. 12, 2015, issued in counterpart Korean Application No. 10-2014-7028185.

* cited by examiner

EMBODIMENT
(WITH INFLOW HOLE)

COMPARATIVE EXAMPLE
(WITHOUT INFLOW HOLE)

FIG. 10

| | SPS APPARATUS | SHAPES OF PERMANENT MAGNETS AFTER SINTERING |
|---|---|---|
| EMBODIMENT | WITH INFLOW HOLE OF DIA 2 mm | NOT VARIED |
| COMPARATIVE EXAMPLE | WITHOUT INFLOW HOLE | VARIED |

FIG. 11

| SAMPLE NO. | LOADED AMOUNT [g] | DENSITY [%] |
|---|---|---|
| 1 | 6.65 | 100.3 |
| 2 | 6.86 | 98.87 |
| 3 | 7.14 | 99.07 |
| 4 | 7.35 | 99.14 |

RARE-EARTH PERMANENT MAGNET, METHOD FOR MANUFACTURING RARE-EARTH PERMANENT MAGNET AND SYSTEM FOR MANUFACTURING RARE-EARTH PERMANENT MAGNET

CROSS REFERENCE TO RELATED APPLICATIONS

This application is a National Stage of International Application No. PCT/JP2013/056434 filed Mar. 8, 2013, claiming priority based on Japanese Patent Application No. 2012-054687 filed Mar. 12, 2012, the contents of all of which are incorporated herein by reference in their entirety.

TECHNICAL FIELD

The present invention relates to a rare-earth permanent magnet, a method for manufacturing the rare-earth permanent magnet and a system for manufacturing the rare-earth permanent magnet.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, film-thinning and a further improvement in magnetic performance have been required of a permanent magnet to be embedded in the permanent magnet motor.

As a method for manufacturing a permanent magnet, for instance, a powder sintering process may be used. In this powder sintering process, first, raw material is coarsely milled and then finely milled into magnet powder by a jet mill (dry-milling method) or a wet bead mill (wet-milling method). Thereafter, the magnet powder is put in a die and pressed to form into a desired shape with a magnetic field applied from outside. Then, the magnet powder formed into the desired shape and solidified is sintered at a predetermined temperature (for instance, at a temperature between 800 and 1150 degrees Celsius for the case of Nd—Fe—B-based magnet) for completion (See, for instance, Japanese Laid-open Patent Application Publication No. 2-266503).

RELATED ART

Patent Document

Patent Document 1: JP Laid-open Patent Application Publication No. 2-266503 (page 5)

DISCLOSURE OF THE INVENTION

Problem to be Solved by the Invention

However, when the permanent magnet is manufactured through the above-mentioned powder sintering method, there have been problems as follows. In mass-producing a plurality of permanent magnets of an identical shape, it is difficult for the plurality of permanent magnets to perfectly equalize the amount of magnet material contained in each of formed bodies before sintering. Thus, even if one and the same molding die or sintering die is used, the difference in the contained magnet material leads to difficulty in attaining identically shaped permanent magnets, resulting in shape variation in produced permanent magnets. Conventionally, it has therefore been required to perform diamond cutting and polishing operations after sintering, for alteration to the identical shape. As a result, the number of manufacturing processes increases, and there also is a possibility of deteriorating qualities of the permanent magnet manufactured. Further, in a case of sintering by pressure sintering specifically, when a loaded amount in a die becomes excessive, the value of pressure to a formed body becomes higher than necessary, causing deficiencies or the like when sintering.

The present invention has been made in order to solve the above-mentioned conventional problems, and an object of the invention is to provide a rare-earth permanent magnet, a method for manufacturing the rare-earth permanent magnet and a system for manufacturing the permanent magnet capable of improving shape uniformity of permanent magnets as well as improving production efficiency in mass-producing permanent magnets of an identical shape.

Means for Solving the Problem

To achieve the above object, the present invention provides a method for manufacturing a rare-earth permanent magnet comprising steps of: milling magnet material into magnet powder; forming the magnet powder into a formed body; arranging the formed body in a die unit of a pressure sintering apparatus; and sintering the formed body arranged in the die unit of the pressure sintering apparatus by pressure-sintering. In the method, the die unit of the pressure sintering apparatus comprises, at least in one direction, an inflow hole configured to receive inflow of part of the pressurized formed body.

In the above-described method for manufacturing a rare-earth permanent magnet of the present invention, the pressure sintering apparatus comprises a plurality of die units, and the pressure sintering apparatus is configured to sinter a plurality of formed bodies simultaneously by the pressure-sintering.

In the above-described method for manufacturing a rare-earth permanent magnet of the present invention, the inflow hole is a hole with a diameter of 1 mm-5 mm.

In the above-described method for manufacturing a rare-earth permanent magnet of the present invention, the inflow hole is formed in a surface that is vertical to a direction of pressure at the pressure-sintering.

In the above-described method for manufacturing a rare-earth permanent magnet of the present invention, in the step of sintering the formed body by the pressure-sintering, the formed body is sintered by uniaxial pressure sintering.

In the above-described method for manufacturing a rare-earth permanent magnet of the present invention, in the step of sintering the formed body by the pressure-sintering, the formed body is sintered by electric current sintering.

In the above-described method for manufacturing a rare-earth permanent magnet of the present invention, in the step of forming the magnet powder into the formed body, the magnet powder is mixed with a binder to prepare a mixture, and the mixture is formed into a sheet-like shape to produce a green sheet as the formed body.

To achieve the above object, the present invention further provides a system for manufacturing a rare-earth permanent magnet configured to mill magnet material into magnet powder, form the magnet powder into a formed body, arrange the formed body in a die unit of a pressure sintering apparatus, and sinter the formed body arranged in the die unit of the pressure sintering apparatus by pressure-sintering, wherein the die unit of the pressure sintering apparatus comprises, at least in one direction, an inflow hole configured to receive inflow of part of the pressurized formed body.

In the above-described system for manufacturing a rare-earth permanent magnet of the present invention, the pressure sintering apparatus comprises a plurality of die units, and the pressure sintering apparatus is configured to sinter a plurality of formed bodies simultaneously by the pressure-sintering.

In the above-described system for manufacturing a rare-earth permanent magnet of the present invention, the inflow hole is a hole with a diameter of 1 mm-5 mm.

In the above-described system for manufacturing a rare-earth permanent magnet of the present invention, the inflow hole is formed in a surface that is vertical to a direction of pressure at the pressure-sintering.

In the above-described system for manufacturing a rare-earth permanent magnet of the present invention, in the step of sintering the formed body by the pressure-sintering, the formed body is sintered by uniaxial pressure sintering.

In the above-described system for manufacturing a rare-earth permanent magnet of the present invention, in the step of sintering the formed body by the pressure-sintering, the formed body is sintered by electric current sintering.

In the above-described system for manufacturing a rare-earth permanent magnet of the present invention, in the step of forming the magnet powder into the formed body, the magnet powder is mixed with a binder to prepare a mixture, and the mixture is formed into a sheet-like shape to produce a green sheet as the formed body.

To achieve the above object, the present invention further provides a rare-earth permanent magnet manufactured through steps of: milling magnet material into magnet powder; forming the magnet powder into a formed body; arranging the formed body in a die unit of a pressure sintering apparatus; and sintering the formed body arranged in the die unit of the pressure sintering apparatus by pressure-sintering. The die unit of the pressure sintering apparatus comprises, at least in one direction, an inflow hole configured to receive inflow of part of the pressurized formed body.

Effect of the Invention

According to the method for manufacturing a rare-earth permanent magnet of the present invention having the above configuration, the die unit of the pressure sintering apparatus includes, at least in one direction, the inflow hole configured to receive inflow of part of the pressurized formed body. As a result, shape uniformity of respective permanent magnets can be improved in mass-producing permanent magnets of an identical shape. In addition, improvement in production efficiency can be achieved through eliminating the need of correction processing after sintering.

Specifically, even if there is a variation in an amount loaded in a die unit of the pressure sintering apparatus, shape uniformity of the permanent magnets can be secured. Further, even if an excessive amount is loaded in a die unit, there is no possibility that a pressure value becomes higher than necessary, and no deficiencies may occur at sintering.

Further, according to the method for manufacturing a rare-earth permanent magnet of the present invention, the pressure sintering apparatus is equipped with a plurality of die units, and simultaneously sinters a plurality of formed bodies by pressure sintering. As a result, further improvement in production efficiency can be attained. Shape variation in the simultaneously sintered permanent magnets can also be prevented.

Further, according to the method for manufacturing a rare-earth permanent magnet of the present invention, the inflow hole is a hole with a diameter of 1 mm-5 mm. The inflow hole having an appropriate shape can facilitate a proper pressure-sintering operation, and also can help maintain an effect of shape uniformity in the sintered permanent magnets.

Further, according to the method for manufacturing a rare-earth permanent magnet of the present invention, the inflow hole is formed in a surface vertical to a direction of pressure at the pressure sintering, enabling further improvement of the effect of shape uniformity, and ensuring easy removal of the sintered permanent magnet from the die unit.

Further, according to the method for manufacturing a rare-earth permanent magnet of the present invention, in the step of sintering the formed body by pressure sintering, the formed body is sintered by uniaxial pressure sintering. The uniaxial pressure sintering helps the permanent magnet to contract uniformly at the sintering, which enables prevention of deformations such as warpage and depressions in the sintered permanent magnet.

Further, according to the rare-earth permanent magnet of the present invention, in the step of sintering the formed body by pressure sintering, the formed body is sintered by electric current sintering. Thereby, heating or cooling of the formed body can be quicker, and the formed body can be sintered in a lower temperature range. As a result, the heating-up and holding periods in the sintering process can be shortened; so that a densely sintered body can be manufactured in which grain growth of the magnet particles is suppressed.

According to the method for manufacturing a rare-earth permanent magnet of the present invention, the rare-earth permanent magnet is produced by mixing magnet powder and a binder and forming the mixture to obtain a green sheet, and sintering the green sheet. The use of the green sheet helps uniform contraction and enables prevention of deformations such as warpage and depressions in the sintered permanent magnet. Also, the use of the green sheet helps prevent uneven pressure at pressurization and eliminates the need of correction processing which has been conventionally performed after sintering, to simplify the manufacturing steps. Thereby, a permanent magnet can be manufactured with dimensional accuracy. Further improvement of the effect of shape uniformity in the sintered permanent magnets can be achieved by the combined implementation of the green sheet with the sintering by the pressure sintering apparatus having the inflow hole.

According to the system for manufacturing a rare-earth permanent magnet of the present invention having the above configuration, the die unit of the pressure sintering apparatus includes, at least in one direction, the inflow hole configured to receive inflow of part of the pressurized formed body. As a result, shape uniformity of respective permanent magnets can be improved in mass-producing permanent magnets of an identical shape. In addition, improvement in production efficiency can be achieved through eliminating the need of correction processing after sintering.

Specifically, even if there is a variation in an amount loaded in a die unit of the pressure sintering apparatus, shape uniformity of the permanent magnets can be secured. Further, even if an excessive amount is loaded in a die unit, there is no possibility that a pressure value becomes higher than necessary, and no deficiencies may occur at sintering.

Further, according to the system for manufacturing a rare-earth permanent magnet of the present invention, the inflow hole is a hole with a diameter of 1 mm-5 mm. The inflow hole having an appropriate shape can facilitate a proper pressure-sintering operation, and also can help maintain an effect of shape uniformity in the sintered permanent magnets.

Further, according to the system for manufacturing a rare-earth permanent magnet of the present invention, the inflow hole is formed in a surface vertical to a direction of pressure at the pressure sintering, enabling further improvement of the effect of shape uniformity, and ensuring easy removal of the sintered permanent magnet from the die unit.

Further, according to the system for manufacturing a rare-earth permanent magnet of the present invention, in the step of sintering the formed body by pressure sintering, the formed body is sintered by uniaxial pressure sintering. The uniaxial pressure sintering helps the permanent magnet to contract uniformly at the sintering, which enables prevention of deformations such as warpage and depressions in the sintered permanent magnet.

Further, according to the rare-earth permanent magnet of the present invention, in the step of sintering the formed body by pressure sintering, the formed body is sintered by electric current sintering. Thereby, heating or cooling of the formed body can be quicker, and the formed body can be sintered in a lower temperature range. As a result, the heating-up and holding periods in the sintering process can be shortened; so that a densely sintered body can be manufactured in which grain growth of the magnet particles is suppressed.

According to the system for manufacturing a rare-earth permanent magnet of the present invention, the rare-earth permanent magnet is produced by mixing magnet powder and a binder and forming the mixture to obtain a green sheet, and sintering the green sheet. The use of the green sheet helps uniform contraction and enables prevention of deformations such as warpage and depressions in the sintered permanent magnet. Also, the use of the green sheet helps prevent uneven pressure at pressurization and eliminates the need of correction processing which has been conventionally performed after sintering, to simplify the manufacturing steps. Thereby, a permanent magnet can be manufactured with dimensional accuracy. Further improvement of the effect of shape uniformity in the sintered permanent magnets can be achieved by the combined implementation of the green sheet with the sintering by the pressure sintering apparatus having the inflow hole.

According to the rare-earth permanent magnet of the present invention having the above configuration, the rare-earth permanent magnet is produced through heating and sintering the formed body, and the die unit of the pressure sintering apparatus that sinters the formed body by pressure-sintering includes, at least in one direction, the inflow hole configured to receive inflow of part of the pressurized formed body. As a result, shape uniformity of respective permanent magnets can be improved in mass-producing permanent magnets of an identical shape. In addition, improvement in production efficiency can be achieved through eliminating the need of correction processing after sintering.

Specifically, even if there is a variation in an amount loaded in a die unit of the pressure sintering apparatus, shape uniformity of the permanent magnets can be secured. Further, even if an excessive amount is loaded in a die unit, there is no possibility that a pressure value becomes higher than necessary, and no deficiencies may occur at sintering.

BRIEF DESCRIPTION OF THE DRAWINGS

FIG. 10 is a table illustrating a comparison result of shapes of permanent magnets manufactured in the embodiment and in the comparative example, respectively.

FIG. 11 is a table relating to a comparison of shape variations of a plurality of permanent magnets simultaneously manufactured in the embodiment.

BEST MODE FOR CARRYING OUT THE INVENTION

A specific embodiment of a rare-earth permanent magnet and a method for manufacturing the rare-earth permanent magnet according to the present invention will be described below in detail with reference to the drawings.

[Constitution of Permanent Magnet]

Figure 1:
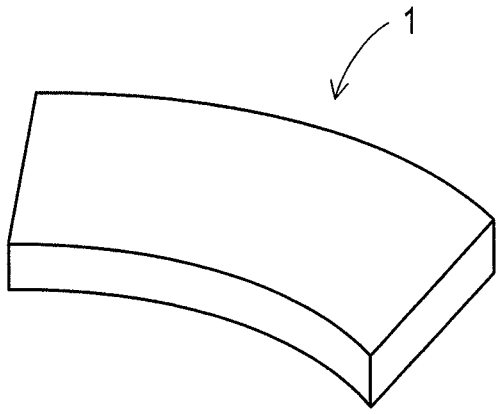
FIG. 1 is an overall view of a permanent magnet according to the invention.

First, a constitution of a permanent magnet 1 according to the present invention will be described. FIG. 1 is an overall view of the permanent magnet 1 according to the present invention. Incidentally, the permanent magnet 1 depicted in FIG. 1 has a fan-like shape; however, the shape of the permanent magnet 1 can be changed according to the shape of a cutting-die.

As the permanent magnet 1 according to the present invention, an Nd—Fe—B-based anisotropic magnet may be used. Incidentally, the contents of respective components are regarded as Nd: 27 to 40 wt %, B: 0.8 to 2 wt %, and Fe (electrolytic iron): 60 to 70 wt %. Furthermore, the permanent magnet 1 may include other elements such as Dy, Tb, Co, Cu, Al, Si, Ga, Nb, V, Pr, Mo, Zr, Ta, Ti, W, Ag, Bi, Zn or Mg in small amount, in order to improve the magnetic properties thereof. FIG. 1 is an overall view of the permanent magnet 1 according to the present embodiment.

The permanent magnet 1 as used herein is a thin film-like permanent magnet having a thickness of 0.05 to 10 mm (for instance, 1 mm), and is prepared by pressure-sintering a formed body formed through powder compaction or a formed body (a green sheet) obtained by forming a mixture (slurry or a powdery mixture) of magnet powder and a binder into a sheet-like shape, as described later.

Meanwhile, as the means for pressure sintering the formed body, there are hot pressing, hot isostatic pressing (HIP), high pressure synthesis, gas pressure sintering, spark plasma sintering (SPS) and the like, for instance. However, it is desirable to adopt a method where sintering is performed in a shorter duration and at a lower temperature, so as to prevent grain growth of the magnet particles during the sintering. It is also desirable to adopt a sintering method capable of suppressing warpage formed in the sintered magnets. Accordingly, specifically in the present invention, it is preferable to adopt the SPS method which is uniaxial pressure sintering in which pressure is uniaxially applied and also in which sintering is performed by electric current sintering, from among the above sintering methods.

Here, the SPS method is a method of heating a sintering object arranged inside a graphite die while pressurizing the sintering object in a uniaxial direction. The SPS method utilizes pulse heating and mechanical pressure application, so that the sintering is driven complexly by electromagnetic energy by pulse conduction, self-heating of the object to be processed and spark plasma energy generated among particles, in addition to thermal or mechanical energy used for ordinary sintering. Accordingly, quicker heating and cooling can be realized, compared with atmospheric heating by an electric furnace or the like, and sintering at a lower temperature range can also be realized. As a result, the heating-up and holding periods in the sintering process can be shortened, making it possible to manufacture a densely sintered body in which grain growth of the magnet particles is suppressed. Further, the sintering object is sintered while being pressurized in a uniaxial direction, so that the warpage after sintering can be suppressed.

Furthermore, the green sheet is die-cut into a desired product shape (for instance, a fan-like shape shown in FIG. 1) to obtain a formed body and the formed body is arranged inside the die unit of an SPS apparatus, upon executing the SPS method. According to the present invention, a plurality of formed bodies (for instance, nine formed bodies) are arranged inside a plurality of die units (for instance, nine die units) provided in the SPS apparatus, respectively, and simultaneously sintered as later described (see FIG. 7) so that the productivity can be increased.

In the present invention, a resin, a long-chain hydrocarbon, a fatty acid methyl ester or a mixture thereof is used as the binder to be mixed with the magnet powder, specifically in the case of manufacturing a permanent magnet 1 through green sheet formation.

Further, if a resin is used as the binder, the resin used is preferably polymers having no oxygen atoms in the structure and being depolymerizable. Meanwhile, in the case where later-described hot-melt molding is employed for producing the green sheet, a thermoplastic resin is preferably used for the convenience of performing magnetic field orientation using the produced green sheet in a heated and softened state. Specifically, an optimal polymer is a polymer or a copolymer of one or more kinds of monomers selected from monomers expressed with the following general formula (1):

[general formula 1]

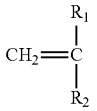

(1)

(wherein $R_1$ and $R_2$ each represent a hydrogen atom, a lower alkyl group, a phenyl group or a vinyl group).

Polymers that satisfy the above condition include: polyisobutylene (PIB) formed from isobutene polymerization, polyisoprene (isoprene rubber or IR) formed from isoprene polymerization, polybutadiene (butadiene rubber or BR) formed from butadiene polymerization, polystyrene formed from styrene polymerization, styrene-isoprene block copolymer (SIS) formed from copolymerization of styrene and isoprene, butyl rubber (IIR) formed from copolymerization of isobutylene and isoprene, styrene-butadiene block copolymer (SBS) formed from copolymerization of styrene and butadiene, poly(2-methyl-1-pentene) formed from polymerization of 2-methyl-1-pentene, poly(2-methyl-1-butene) formed from polymerization of 2-methyl-1-butene, and poly (alpha-methylstyrene) formed from polymerization of alpha-methylstyrene. Incidentally, low molecular weight polyisobutylene is preferably added to the poly(alpha-methylstyrene) to produce flexibility. Further, resins to be used for the binder may include small amount of polymer or copolymer of monomers containing oxygen atoms (such as polybutylmethacrylate or polymethylmethacrylate). Further, monomers not satisfying the above general formula (1) may be partially copolymerized. Even in such a case, the purpose of this invention can be realized.

Incidentally, the binder is preferably made of a thermoplastic resin that softens at 250 degrees Celsius or lower, or specifically, a thermoplastic resin whose glass transition point or melting point is 250 degrees Celsius or lower.

Meanwhile, in a case a long-chain hydrocarbon is used for the binder, there is preferably used a long-chain saturated hydrocarbon (long-chain alkane) being solid at room temperature and being liquid at a temperature higher than the room temperature. Specifically, a long-chain saturated hydrocarbon having 18 or more carbon atoms is preferably used. In the case of employing the later-described hot-melt molding for forming the green sheet, the magnetic field orientation of the green sheet is performed under a state where the green sheet is heated and softened at a temperature higher than the melting point of the long-chain hydrocarbon.

In a case where a fatty acid methyl ester is used for the binder, there are preferably used methyl stearate, methyl docosanoate, etc., being solid at room temperature and being liquid at a temperature higher than the room temperature, similar to long-chain saturated hydrocarbon. In the case of using the later-described hot-melt molding when forming the green sheet, the magnetic field orientation of the green sheet is performed under a state where the green sheet is heated to be softened at a temperature higher than the melting point of fatty acid methyl ester.

Through using a binder that satisfies the above condition as binder to be mixed with the magnet powder when preparing the green sheet, the carbon content and oxygen content in the magnet can be reduced. Specifically, the carbon content remaining after sintering is made 2000 ppm or lower, or more preferably, 1000 ppm or lower. Further, the oxygen content remaining after sintering is made 5000 ppm or lower, or more preferably, 2000 ppm or lower.

Further, the amount of the binder to be added is an optimal amount to fill the gaps between magnet particles so that thickness accuracy of the sheet can be improved when forming the slurry or the heated and molten mixture into a sheet-like shape. For instance, the binder proportion to the amount of magnet powder and binder in total in the slurry after the addition of the binder is preferably 1 wt % through 40 wt %, more preferably 2 wt % through 30 wt %, or still more preferably 3 wt % through 20 wt %.

[Method for Manufacturing Permanent Magnet]

Figure 2:
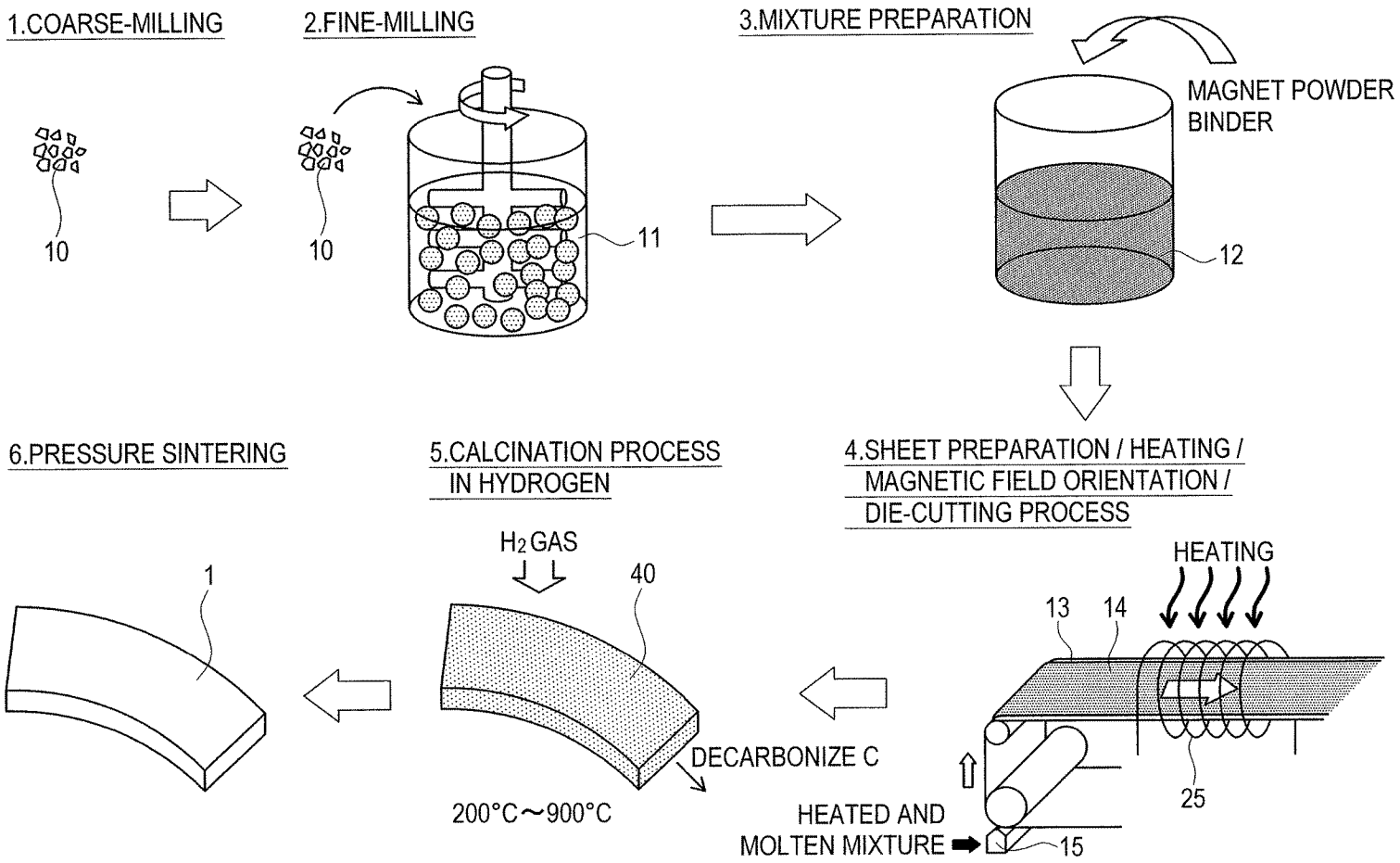
FIG. 2 is an explanatory diagram illustrating a manufacturing process of a permanent magnet according to the invention.

Next, a method for manufacturing the permanent magnet 1 according to the present invention will be described below with reference to FIG. 2. FIG. 2 is an explanatory view illustrating a manufacturing process of the permanent magnet 1 according to the present invention.

First, there is manufactured an ingot comprising Nd—Fe—B of certain fractions (for instance, Nd: 32.7 wt %, Fe (electrolytic iron): 65.96 wt %, and B: 1.34 wt %). Thereafter the ingot is coarsely milled using a stamp mill, a crusher, etc. to a size of approximately 200 μm. Otherwise, the ingot is melted, formed into flakes using a strip-casting method, and then coarsely milled using a hydrogen pulverization method. Thus, coarsely milled magnet powder 10 can be obtained.

Following the above, the coarsely milled magnet powder 10 is finely milled by a wet method using a bead mill 11 or a dry method using a jet mill, etc. For instance, in fine milling using a wet method by the bead mill 11, the coarsely milled magnet powder 10 is finely milled to a particle size within a predetermined range (for instance, 0.1 μm through 5.0 μm) in an organic solvent and the magnet powder is dispersed in the organic solvent. Thereafter, the magnet powder included in the organic solvent after the wet milling is dried by such a method as vacuum desiccation to obtain the dried magnet powder. The solvent to be used for milling is an organic solvent, but the type of the solvent is not specifically limited, and may include: alcohols such as isopropyl alcohol, ethanol and methanol; esters such as ethyl acetate; lower hydrocarbons such as pentane and hexane; aromatic series such as benzene, toluene and xylene; ketones; and a mixture thereof. However, there is preferably used a hydrocarbon-solvent including no oxygen atoms in the solvent.

In the fine-milling using the dry method with the jet mill, however, the coarsely milled magnet powder is finely milled in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%, with a jet mill, to form fine powder of which the average particle diameter is within a predetermined size range (for instance, 1.0 μm through 5.0 μm). Here, the term "having an oxygen content of substantially 0%" is not limited to a case where the oxygen content is completely 0%, but may include a case where oxygen is contained in such an amount as to allow a slight formation of an oxide film on the surface of the fine powder.

Thereafter, the magnet powder finely milled by the bead mill 11, etc. is formed into a desired shape. Incidentally, methods for formation of the magnet powder include powder compaction using a metal die to mold the magnet powder into the desired shape, and green sheet formation in which the magnet powder is first formed into a sheet-like shape and then the sheet-like magnet powder is punched out into the desired shape. Further, the powder compaction includes a dry method of filling a cavity with desiccated fine powder and a wet method of filling a cavity with slurry including the magnet powder without desiccation. Meanwhile, the green sheet formation includes, for instance, hot-melt molding in which a mixture of magnet powder and a binder is prepared and formed into a sheet-like shape, and slurry molding in which a base is coated with slurry including magnet powder, a binder and an organic solvent, to form the slurry into a sheet-like shape.

Hereinafter, the green sheet formation using hot-melt molding is discussed. First, a binder is added to the magnet powder finely milled by the jet mill 11 or the like, to prepare a powdery mixture (a mixture) 12 of the magnet powder and the binder. Here, as mentioned above, there can be used a resin, a long-chain hydrocarbon, a fatty acid methyl ester or a mixture thereof as binder. For instance, when a resin is employed, it is preferable that the resin is made of a polymer or copolymer of monomers containing no oxygen atoms, and when a long-chain hydrocarbon is employed, it is preferable that a long-chain saturated hydrocarbon (long-chain alkane) is used. In a case where a fatty acid methyl ester is used for the binder, there are preferably used methyl stearate, methyl docosanoate, etc. Here, as mentioned above, the amount of binder to be added is preferably such that binder proportion to the amount of the magnet powder and the binder in total in the mixture 12 after the addition is within a range of 1 wt % through 40 wt %, more preferably 2 wt % through 30 wt %, or still more preferably 3 wt % through 20 wt %. Here, the addition of the binder is performed in an atmosphere composed of inert gas such as nitrogen gas, Ar gas or He gas. Here, at mixing the magnet powder and the binder together, the magnet powder and the binder are, for instance, respectively put into an organic solvent and stirred with a stirrer. After stirring, the organic solvent containing the magnet powder and the binder is heated to volatilize the organic solvent, so that the mixture 12 is extracted. It is preferable that the binder and the magnet powder is mixed under an atmosphere composed of inert gas such as nitrogen gas, Ar gas, helium He gas or the like. Further, specifically when the magnet powder is milled by a wet method, the binder may be added to an organic solvent used for the milling and kneaded, and thereafter the organic solvent is volatilized to obtain the mixture 12, without isolating the magnet powder out of the organic solvent used for the milling.

Subsequently, the green sheet is prepared through forming the mixture into a sheet-like shape. Specifically, in the hot-melt molding, the mixture 12 is heated to melt, and turned into a fluid state, and then coats the supporting base 13 such as a separator. Thereafter, the mixture 12 coating the supporting base 13 is left to cool and solidify, so that the green sheet 14 can be formed in a long sheet fashion on the supporting base 13. Incidentally, the appropriate temperature for thermally melting the mixture 12 differs depending on the kind or amount of binder to be used, but is set here within a range of 50 through 300 degrees Celsius. However, the temperature needs to be higher than the melting point of the binder to be used. Incidentally, when the slurry molding is employed, the magnet powder and the binder are dispersed in an organic solvent such as toluene to obtain slurry, and a supporting base 13 such as a separator is coated with the slurry. Thereafter, the organic solvent is dried to volatilize so as to produce the green sheet 14 in a long sheet fashion on the supporting base 13.

Here, the coating method of the molten mixture 12 is preferably a method excellent in layer thickness controllability, such as a slot-die system and a calender roll system. For instance, in the slot-die system, the mixture 12 heated to melt into a fluid state is extruded by a gear pump to put into a slot die, and then coating is performed. In the calender roll system, a predetermined amount of the mixture 12 is enclosed in a gap between two heated rolls, and the supporting base 13 is coated with the mixture 12 melted by the heat of the rolls, while the rolls are rotated. As supporting base 13, a silicone-treated polyester film is used, for instance. Further, a defoaming agent or a heat and vacuum defoaming method may preferably be employed in conjunction therewith to sufficiently perform defoaming treatment so that no air bubbles remain in a layer of coating. Further, instead of coating the supporting base 13, extrusion molding may be employed that molds the molten mixture 12 into a sheet and extrudes the sheet-like mixture 12 onto the supporting base 13, so that a green sheet 14 is formed on the supporting base 13.

Figure 3:
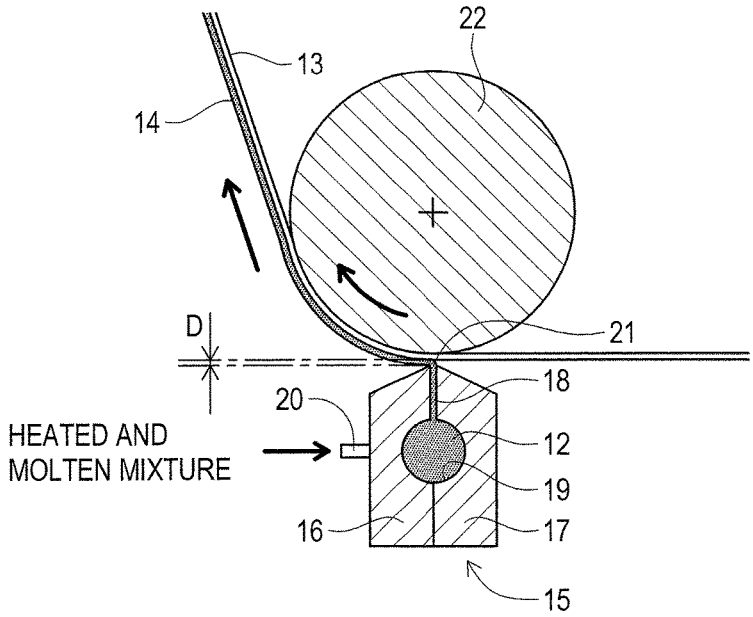
FIG. 3 is an explanatory diagram specifically illustrating a formation process of the green sheet in the manufacturing process of the permanent magnet according to the invention.

Here will be given a detailed description of the formation process of a green sheet 14 employing a slot-die system referring to FIG. 3. FIG. 3 is an explanatory diagram illustrating the formation process of the green sheet 14 employing the slot-die system.

As illustrated in FIG. 3, a slot die 15 used for the slot-die system is formed by putting blocks 16 and 17 together. There, a gap between the blocks 16 and 17 serves as a slit 18 and a cavity (liquid pool) 19. The cavity 19 communicates with a die inlet 20 formed in the block 17. Further, the die inlet 20 is connected to a coating fluid feed system configured with the gear pump and the like (not shown), and the cavity 19 receives the feed of metered fluid-state mixture 12 through the die inlet 20 by a metering pump and the like (not shown). Further, the fluid-state mixture 12 fed to the cavity 19 is delivered to the slit 18, and discharged at a predetermined coating width from a discharge outlet 21 of the slit 18, with pressure which is uniform in transverse direction in a constant amount per unit of time. Meanwhile, the supporting base 13 is conveyed along the rotation of a coating roll 22 at a predetermined speed. As a result, the discharged fluid-state mixture 12 is laid down on the supporting base 13 with a predetermined thickness. Thereafter, the mixture 12 is left to cool and solidify, so that a long-sheet-like green sheet 14 is formed on the supporting base 13.

Further, in the formation process of the green sheet 14 by the slot-die system, it is desirable to measure the actual sheet thickness of the green sheet 14 after coating, and to perform feedback control of a gap D between the slot die 15 and the supporting base 13 based on the measured thickness. Further, it is desirable to minimize the variation in feed rate of the fluid-state mixture 12 supplied to the slot die 15 (for instance, to suppress the variation within plus or minus 0.1%), and in addition, to also minimize the variation in coating speed (for instance, suppress the variation within plus or minus 0.1%). As a result, thickness precision of the green sheet 14 can further be improved. Incidentally, the thickness precision of the formed green sheet is within a margin of error of plus or minus 10% with reference to a designed value (for instance, 1 mm), preferably within plus or minus 3%, or more preferably within plus or minus 1%. Alternatively, in the calendar roll system, the film thickness of the transferred mixture 12 on the supporting base 13 can be controlled through controlling a calendering condition according to an actual measurement value.

Incidentally, a preset thickness of the green sheet 14 is desirably within a range of 0.05 mm through 20 mm. If the thickness is set to be thinner than 0.05 mm, it becomes necessary to laminate many layers, which lowers the productivity.

Next, magnetic field orientation is carried out to the green sheet 14 formed on the supporting base 13 by the above mentioned hot-melt molding. To begin with, the green sheet 14 conveyed together with the supporting base 13 is heated to soften. Incidentally, the appropriate temperature and duration for heating the green sheet 14 differ depending on the type or amount of the binder, but can be tentatively set, for instance, at 100 through 250 degrees Celsius, and 0.1 through minutes, respectively. However, for the purpose of softening the green sheet 14, the temperature needs to be equal to or higher than the glass transition point or melting point of the binder to be used. Further, the heating method for heating the green sheet 14 may be such a method as heating by a hot plate, or heating using a heat carrier (silicone oil) as a heat source, for instance. Further, magnetic field orientation is performed by applying magnetic field in an in-plane and machine direction of the green sheet 14 that has been softened by heating. The intensity of the applied magnetic field is 5000 [Oe] through 150000 [Oe], or preferably 10000 [Oe] through 120000 [Oe]. As a result, c-axis (axis of easy magnetization) of each magnet crystal grain included in the green sheet 14 is aligned in one direction. Incidentally, the application direction of the magnetic field may be an in-plane and transverse direction of the green sheet 14. Further, magnetic field orientation may be simultaneously performed to plural pieces of the green sheet 14.

Further, as to the application of the magnetic field to the green sheet 14, the magnetic field may be applied simultaneously with the heating, or the magnetic field may be applied after the heating and before the green sheet 14 solidifies. Further, the magnetic field may be applied before the green sheet 14 formed by the hot-melt molding solidifies. In such a case, the need of the heating process is eliminated.

Figure 4:
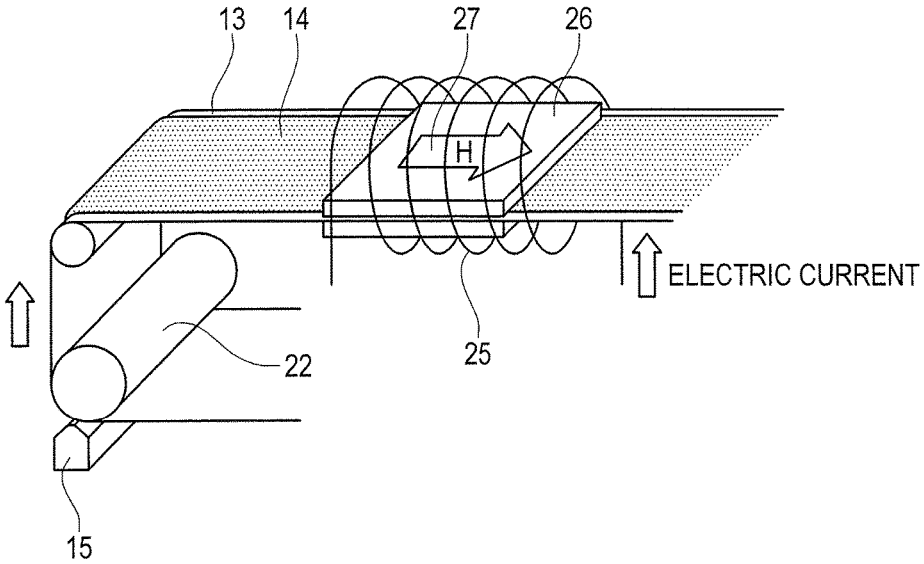
FIG. 4 is an explanatory diagram specifically illustrating a heating process and a magnetic field orientation process of the green sheet in the manufacturing process of the permanent magnet according to the invention.

Next, there will be described on a heating process and a magnetic field orientation process of the green sheet 14 in more detail, referring to FIG. 4. FIG. 4 is an explanatory diagram illustrating a heating process and a magnetic field orientation process of the green sheet 14. Referring to FIG. 4, there will be discussed an example which carries out the heating process and the magnetic field orientation simultaneously.

As shown in FIG. 4, heating and magnetic field orientation are performed on the green sheet 14 formed by the above described slot-die system into a long-sheet-like shape and continuously conveyed by a roll. That is, apparatuses for heating and magnetic field orientation are arranged at the downstream side of a coating apparatus (such as slot-die apparatus) so as to perform heating and magnetic field orientation subsequent to the coating process.

More specifically, a solenoid 25 is arranged at the downstream side of the slot die 15 or the coating roll 22 so that the green sheet 14 and the supporting base 13 being conveyed together pass through the solenoid 25. Further, inside the solenoid 25, hot plates 26 are arranged as a pair on upper and lower sides of the green sheet 14. While heating the green sheet 14 by the hot plates 26 arranged as a pair on the upper and lower sides, electrical current is applied to the solenoid 25 and magnetic field is generated in an in-plane direction (i.e., direction parallel to a sheet surface of the green sheet 14) as well as a machine direction of the long-sheet-like green sheet 14. Thus, the continuously-conveyed green sheet 14 is softened through heating, and magnetic field (H) is applied to the softened green sheet 14 in the in-plane and machine direction of the green sheet 14 (arrow 27 direction in FIG. 4). Thereby, homogeneous and optimized magnetic field orientation can be performed on the green sheet 14. Especially, application of magnetic field in the in-plane direction thereof can prevent surface of the green sheet 14 from bristling up.

Further, the green sheet 14 subjected to the magnetic field orientation is preferably cooled and solidified under the conveyed state, for the sake of higher efficiency at manufacturing processes.

Incidentally, when performing the magnetic field orientation in an in-plane and transverse direction of the green sheet 14, the solenoid 25 is replaced with a pair of magnetic coils arranged on the right and left sides of the conveyed green sheet 14. Through energizing both magnetic coils, a magnetic field can be generated in an in-plane and transverse direction of the long sheet-like green sheet 14.

Figure 5:
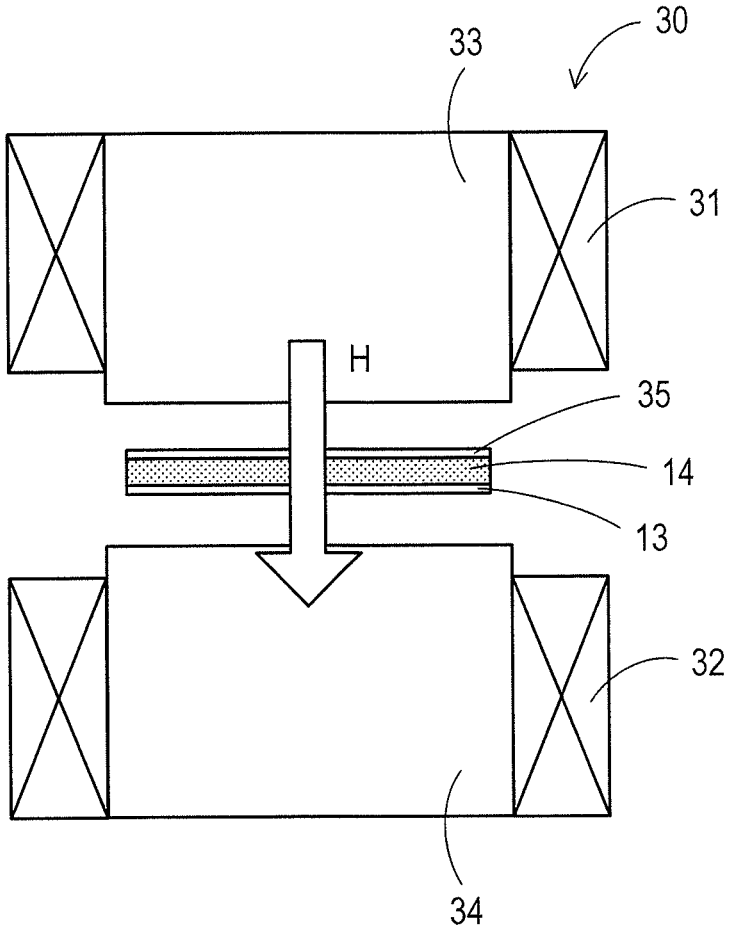
FIG. 5 is a diagram illustrating an example of the magnetic field orientation in a direction perpendicular to a plane of the green sheet.

Further, the magnetic field may be oriented in a direction perpendicular to a plane of the green sheet 14. When orienting the magnetic field in the direction perpendicular to a plane of the green sheet 14, there may be used, for instance, a magnetic field application apparatus using pole pieces, etc. Specifically, as illustrated in FIG. 5, a magnetic field application apparatus 30 using pole pieces has two ring-like coil portions 31, 32, and two substantially columnar pole pieces 33, 34. The coil portions 31, 32 are arranged in parallel with each other and coaxially aligned. The pole pieces 33, 34 are arranged inside ring holes of the coil portions 31, 32, respectively. The magnetic field application apparatus 30 is arranged to have a predetermined clearance to a green sheet 14 being conveyed. The coil portions 31, 32 are energized to generate a magnetic field (H) in the direction perpendicular to the plane of the green sheet 14, so that the green sheet 14 is subjected to the magnetic field orientation. However, in the case where the magnetic field is applied in the direction perpendicular to the plane of the green sheet 14, a film 35 is desirably laminated on top of the green sheet 14, on a surface opposite to the surface with the supporting base 13 laminated, as shown in FIG. 5. The surface of the green sheet 14 can thereby be prevented from bristling up.

Figure 6:
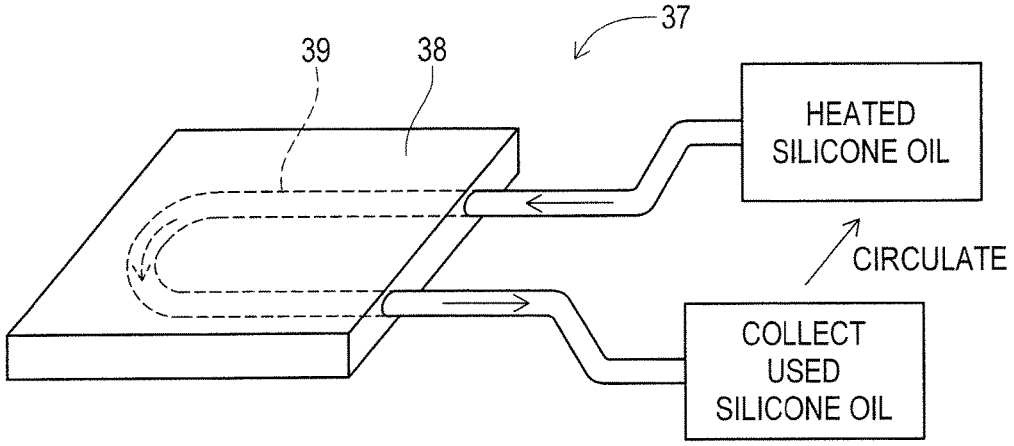
FIG. 6 is an explanatory diagram illustrating a heating device using a heat carrier (silicone oil).

Further, instead of the heating method that uses the above-mentioned hot plates 26, there may be employed a heating method that uses a heat carrier (silicone oil) as a heat source. FIG. 6 is an explanatory diagram illustrating a heating device 37 having a heat carrier.

As shown in FIG. 6, the heating device 37 has a flat plate member 38 as a heater element. The flat plate member 38 has a substantially U-shaped channel 39 formed inside thereof, and silicone oil heated to a predetermined temperature (for instance, 100 through 300 degrees Celsius) is circulated inside the channel 39, as a heat carrier. Then, in place of the hot plates 26 illustrated in FIG. 4, the heating devices 37 are arranged inside the solenoid 25 as a pair on the upper and lower sides of the green sheet 14. As a result, the flat plate members made hot by the heat carrier heats and softens the continuously conveyed green sheet 14. The flat plate member 38 may make direct contact with the green sheet 14, or may have a predetermined clearance to the green sheet 14. Then a magnetic field is applied to the green sheet 14 in an in-plane and machine direction thereof (direction of arrow 27 in FIG. 4) by the solenoid 25 arranged around the softened green sheet 14, so that the green sheet 14 can be optimally magnetized to have a uniform magnetic field orientation. Unlike a common hot plate 26, there is no internal electric heating cable in such a heating device 37 employing a heat carrier as shown in FIG. 6. Accordingly, even arranged inside a magnetic field, the heating device 37 does not induce a Lorentz force which may cause vibration or breakage of an electric heating cable, and thereby optimal heating of the green sheet 14 can be realized. Further, heat control by electric current may involve a problem that the ON or OFF of the power causes the electric heating cable to vibrate, resulting in fatigue fracture thereof. However, such a problem can be resolved by using a heating device 37 with a heat carrier as a heat source.

Here, the green sheet 14 may be formed using highly fluid liquid material such as slurry, by a conventional slot-die system or a doctor blade system, without employing the hot-melt molding. In such a case, when the green sheet 14 is conveyed into and exposed to the gradients of magnetic field, the magnet powder contained in the green sheet 14 is attracted to a stronger magnetic field. Thereby, liquid distribution of the slurry forming the green sheet 14 becomes imbalanced, resulting in the green sheet 14 with problematic unevenness in thickness. In contrast, in the case where the hot-melt molding is employed for forming the mixture 12 into a green sheet 14 as in the present invention, the viscosity of the mixture 12 reaches several tens of thousands Pa·s in the vicinity of the room temperature. Thus, imbalanced distribution of magnet powder can be prevented at the time the green sheet 14 is exposed to the gradients of magnetic field. Further, the viscosity of the binder therein lowers as the green sheet 14 is conveyed into a homogenous magnetic field and heated, and uniform c-axis orientation becomes attainable merely by the rotary torque in the homogeneous magnetic field.

Further, if the green sheet 14 is formed using highly fluid liquid material such as slurry by a conventional slot-die system or a doctor blade system without employing the hot-melt molding, problematic bubbles are generated at a drying process by evaporation of an organic solvent included in the slurry, when a sheet exceeding 1 mm thick is to be manufactured. Further, the duration of the drying process may be extended in an attempt to suppress bubbles. However, in such a case, the magnet powder is caused to precipitate, resulting in imbalanced density distribution of the magnet powder with regard to the gravity direction. This may lead to warpage of the permanent magnet after sintering. Accordingly, in the formation from the slurry, the maximum thickness is virtually restricted, and a green sheet 14 needs to be equal to or thinner than 1 mm thick and be laminated thereafter. However, in such a case, the binder cannot be sufficiently intermingled. This causes delamination at the binder removal process (calcination process), leading to degradation in the orientation in the c-axis (axis of easy magnetization), namely, decrease in residual magnetic flux density (Br). In contrast, in the case where the mixture 12 is formed into a green sheet 14 using hot-melt molding as in the present invention, as the mixture 12 contains no organic solvent, there is no possibility of such bubbles as mentioned in the above, even if a sheet over 1 mm thick is prepared. Further, the binder is well intermingled, and no delamination occurs at the binder removal process.

Further, if plural pieces of green sheet 14 are simultaneously exposed to the magnetic field, for instance, the plural pieces of green sheet 14 stacked in multiple layers (for instance, six layers) are continuously conveyed, and the stacked multiple layers of green sheet 14 are made to pass through the inside of the solenoid 25. Thus, the productivity can be improved.

Then, the green sheet 14 is die-cut into a desired product shape (for example, the fan-like shape shown in FIG. 1) to produce a formed body 40.

Thereafter, the formed body 40 thus produced is held at a binder-decomposition temperature for several hours (for instance, five hours) in a non-oxidizing atmosphere (specifically in this invention, a hydrogen atmosphere or a mixed gas atmosphere of hydrogen and inert gas) at a pressure higher than or lower than the normal atmospheric pressure (for instance, 1.0 MPa or 1.0 Pa), and a calcination process is performed. The hydrogen feed rate during the calcination is, for instance, 5 L/min, if the calcination is performed in the hydrogen atmosphere. By the calcination process, the binder can be decomposed into monomers through depolymerization reaction, released and removed therefrom. Namely, so-called decarbonization is performed in which carbon content in the formed body 40 is decreased. Furthermore, the calcination process is to be performed under such a condition that carbon content in the formed body 40 is 2000 ppm or lower, or more preferably 1000 ppm or lower. Accordingly, it becomes possible to sinter the permanent magnet 1 densely as a whole in the sintering process that follows, and the decrease in the residual magnetic flux density or in the coercive force can be prevented. Furthermore, if the pressure higher than the atmospheric pressure is employed with regard to a pressurization condition at the calcination process, the pressure is preferably 15 MPa or lower.

The temperature for decomposing the binder is determined based on the analysis of the binder decomposition products and decomposition residues. In particular, the temperature range to be selected is such that, when the binder decomposition products are trapped, no decomposition products except monomers are detected, and when the residues are analyzed, no products due to the side reaction of remnant binder components are detected. The temperature differs depending on the type of binder, but may be set at 200 through 900 degrees Celsius, or more preferably 400 through 600 degrees Celsius (for instance, 600 degrees Celsius).

Further, in the case where the magnet raw material is milled in an organic solvent by wet-milling, the calcination process is performed at a decomposition temperature of the organic compound composing the organic solvent as well as the binder decomposition temperature. Accordingly, it is also made possible to remove the residual organic solvent. The decomposition temperature for an organic compound is determined based on the type of organic solvent to be used, but the above binder decomposition temperature is basically sufficient to thermally decompose the organic compound.

Further, a dehydrogenation process may be carried out through successively holding, in a vacuum atmosphere, the formed body 40 calcined at the calcination process. In the dehydrogenation process, $NdH_3$ (having high reactivity level) in the formed body 40 created at the calcination process is gradually changed, from $NdH_3$ (having high reactivity level) to $NdH_2$ (having low reactivity level). As a result, the reactivity level is decreased with respect to the formed body 40 activated by the calcination process. Accordingly, if the formed body 40 calcined at the calcination process is later moved into the atmosphere, Nd therein is prevented from combining with oxygen, and the decrease in the residual magnetic flux density and coercive force can also be prevented. Further, there can be expected an effect of putting the crystal structure of the magnet from those with $NdH_2$ or the like back to the structure of $Nd_2Fe_{14}B$.

Thereafter, a sintering process is performed in which the formed body 40 calcined in the calcination process is sintered. Incidentally, as a sintering method of the formed body 40, pressure sintering is specifically employed, in which the formed body 40 is sintered in a pressurized state. Here, methods for the pressure sintering include, for instance, hot pressing, hot isostatic pressing (HIP), high pressure synthesis, gas pressure sintering, spark plasma sintering (SPS) and the like. However, it is preferable to adopt the SPS method, which is uniaxial pressure sintering, in which pressure is uniaxially applied and also in which sintering is performed by electric current sintering so as to prevent grain growth of the magnet particles during the sintering and also to prevent warpage formed in the sintered magnets. When the pressure sintering is performed, it is preferable to configure such that a plurality of formed bodies 40 (for instance, nine formed bodies 40) are simultaneously sintered, for the purpose of increasing productivity. Specifically, employing the SPS apparatus equipped with a plurality of die units (for instance, nine die units), the formed bodies 40 are arranged inside the plurality of die units, respectively, and simultaneously sintered. When the SPS method is performed, it is preferable that the pressure value is set, for instance, at 0.01 MPa through 100 MPa, and the temperature is raised to approximately 940 degrees Celsius at a rate of 10 degrees C./min. in a vacuum atmosphere of several Pa or lower, and held for five minutes. The formed body 40 is then cooled down, and again undergoes a heat treatment in 300 through 1000 degrees Celsius for two hours. As a result of the sintering, the permanent magnet 1 is manufactured.

Figure 7:
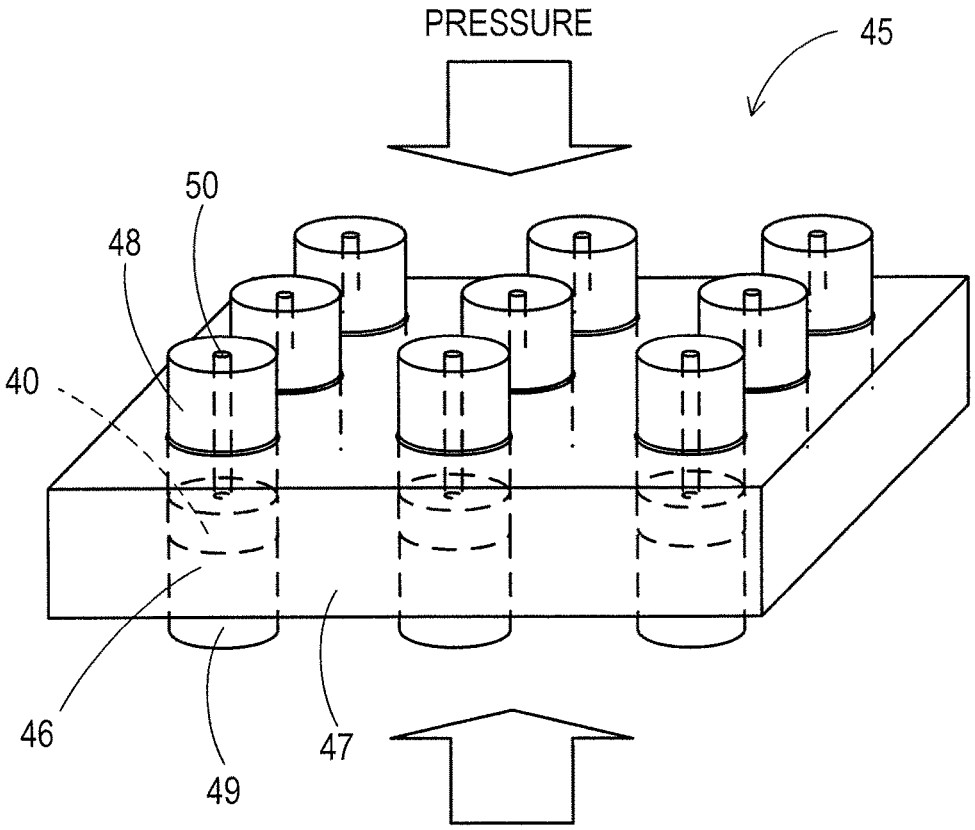
FIG. 7 is an overall view of a spark plasma sintering (SPS) apparatus.
Figure 8:
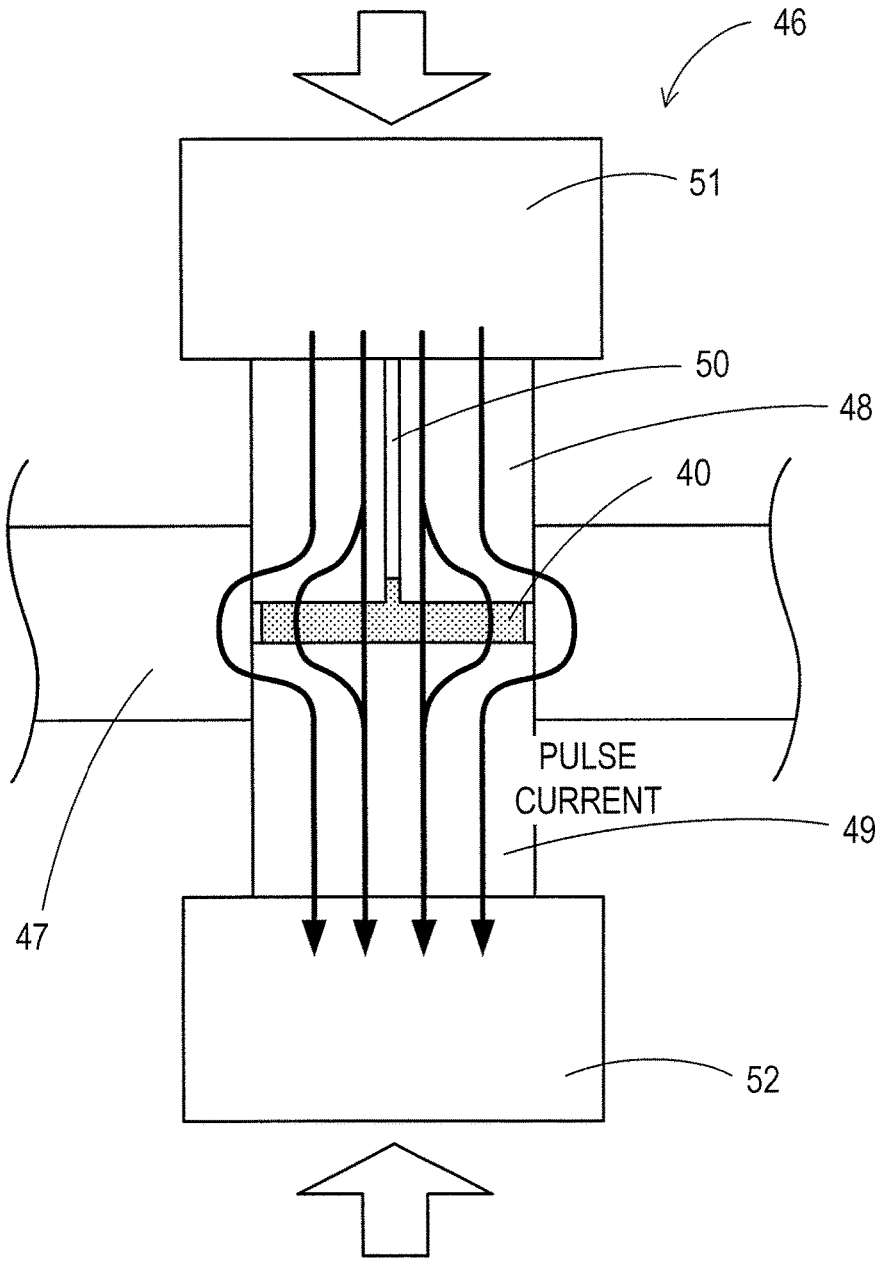
FIG. 8 is a schematic diagram depicting an internal configuration of one die unit provided in the SPS apparatus.

Here will be given a detailed description of the pressure sintering process of a formed body 40 using the SPS method, referring to FIGS. 7 and 8. FIG. 7 is an overall view of an SPS apparatus 45. FIG. 8 is a schematic diagram depicting an internal configuration of one die unit provided in the SPS apparatus.

As illustrated in FIG. 7, the SPS apparatus 45 is equipped with a plurality of die units 46 (nine die units 46 in FIG. 7) and is arranged inside a vacuum chamber (not shown). As illustrated in FIG. 7 and FIG. 8, a die unit 46 has a graphite die 47 having a cylindrical cavity, and an upper punch 48 and a lower punch 49 also made of graphite arranged respectively above and below the cylindrical cavity of the die 47; however, the shape of the cavity can be altered according to a desired final product shape. The die 47, the upper punch 48 and the lower punch 49 make up a cylindrical space portion, inside which each of formed bodies 40 is placed; however, the shape of the space portion can be altered according to the desired final product shape. The upper punch 48 is provided with an inflow hole 50 configured to receive an inflow of part of a pressurized formed body. The inflow hole 50 enables fine adjustment of variation, if such variation exists, in height or volume of formed bodies 40 before sintering, as part of pressurized formed body 40 flows into the inflow hole 50 when pressure is applied. As a result, it becomes possible to improve uniformity of the shapes of permanent magnets 1 after pressure-sintering. Specifically, in a case of performing simultaneous sintering on a plurality of formed bodies 40 as shown in FIG. 7, the uniformity of the shapes of permanent magnets 1 simultaneously sintered can further be improved. The inflow hole 50 is preferably formed in a face vertical to the direction of pressure at the pressure-sintering (for instance, a face of the upper punch 48 or the lower punch 49). However, the inflow hole 50 may be formed in another direction (for instance, in an inner face of the die 47). A plurality of inflow holes 50 may be formed in a plurality of locations. There is no specific limitation to the size of an inflow hole 50; however, an excessively large inflow hole 50 may hinder proper pressure sintering and an excessively small inflow hole 50 may deteriorate the improvement of uniformity. Accordingly, the inflow hole 50 of a size within a range of 1 mm-5 mm may preferably be employed. The inflow hole 50 may be a penetration hole penetrating to the outside of the die unit 46, or may be a non-penetration hole.

When performing the pressure sintering by an SPS apparatus 45, first, a formed body 40 is put inside a die unit 46. Incidentally, the above calcination process may also be performed under this state where the formed body 40 is put inside the die unit 46. After that, using an upper punch electrode 51 coupled to the upper punch 48 and a lower punch electrode 52 coupled to the lower punch 49, pulsed DC voltage/current being low voltage and high current is applied. At the same time, a load is applied to the upper punch 48 and the lower punch 49 from upper and lower directions using a pressurizing mechanism (not shown). As a result, the formed body 40 put inside the die unit 46 is sintered while being pressurized. Incidentally, the upper punches 48 and the lower punches 49 for pressing the formed bodies 40 are configured to be integrally used for the plurality of die units 46 (so that the pressure can be applied simultaneously by the upper punches 48 and the lower punches 49 which are integrally operated). Further, a plurality of formed bodies 40 may be put in one die unit 46.

Incidentally, the detailed sintering condition is as follows:

Pressure value: 1 MPa

Sintering temperature: raised by 10 deg. C. per min. up to 940 deg. C. and held for 5 min.

Atmosphere: vacuum atmosphere of several Pa or lower.

The above example describes an SPS apparatus 45 equipped with a plurality of die units 46 and capable of performing simultaneous spark plasma sintering to a plurality of formed bodies 40, in order to improve productivity. However, there may be employed an SPS apparatus 45 equipped with only a single die unit 46 and capable of performing spark plasma sintering only to a single formed body 40. Even in such a case, shape uniformity can be improved in the sequentially produced permanent magnets.

Embodiment

An embodiment according to the present invention will now be described referring to a comparative example for comparison.

Embodiment

In the embodiment, there has been used an Nd—Fe—B-based magnet, and alloy composition thereof has been Nd/Fe/B32.7/65.96/1.34 in wt %. Polyisobutylene (PIB) has been used as binder. A green sheet has been obtained through coating the base with the heated and molten mixture by a slot-die system. Further, the obtained green sheet has been heated for five minutes with hot plates whose temperature has been raised to 200 degrees Celsius, and magnetic field orientation has been performed through applying a 12 T magnetic field to the green sheet in the in-plane and machine direction. After the magnetic field orientation, the green sheet has been punched out into a desired shape and calcined in hydrogen atmosphere, and thereafter, the punched-out green sheet has been sintered by SPS method (at pressure value of 1 MPa, raising sintering temperature by 10 degrees Celsius per minute up to 940 degrees Celsius and holding it for 5 minutes). As to the spark plasma sintering, as illustrated in FIG. 7, a plurality of formed bodies have been simultaneously sintered using an SPS apparatus 45 equipped with a plurality of die units 46, and a plurality of permanent magnets have been obtained. Each of the plurality of formed bodies being the simultaneous sintering targets has been formed such that the amounts of the magnet material therein are slightly different (specifically, four patterns of 6.65 g, 6.86 g, 7.14 g, and 7.35 g). As an inflow hole 50, an inflow hole 50 with a diameter of 2 mm has been formed in each of the upper punch 48 and the lower punch 49. Other processes are the same as the processes in [Method for Manufacturing Permanent Magnet] mentioned above.

Comparative Example

Permanent magnets have been manufactured through sintering formed bodies using an SPS apparatus 45 with no inflow hole. Other conditions are the same as the conditions in the embodiment.

Comparative Discussion of Embodiment with Comparative Example

Figure 9:
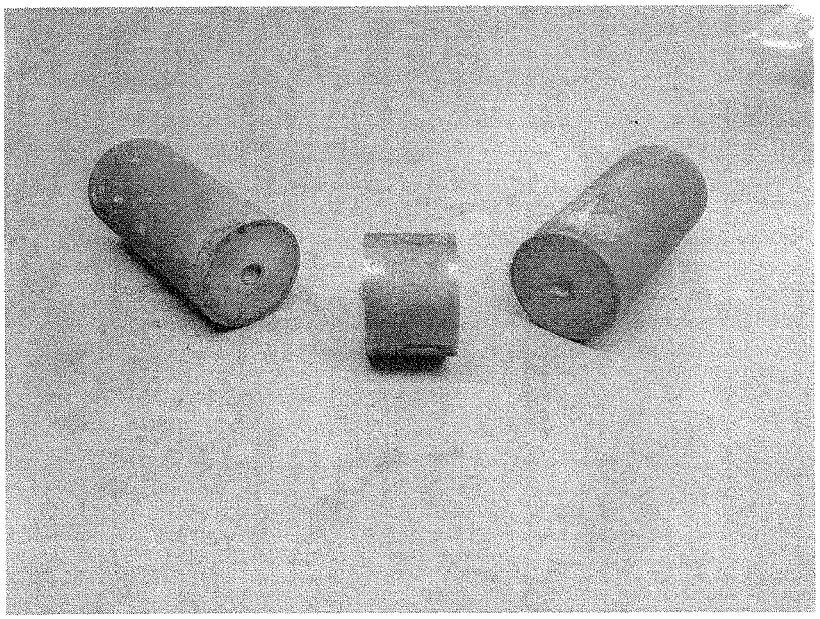
FIG. 9 is photographs for showing external appearances of permanent magnets manufactured in an embodiment and in a comparative example, respectively.
Figure 9:
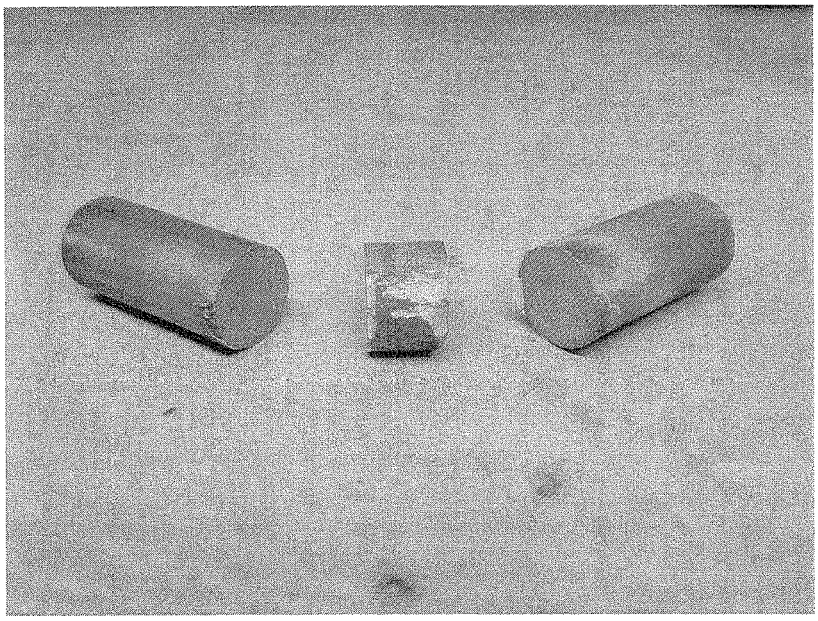

FIG. 9 is photographs for showing external appearances of permanent magnets with the largest material amount, 7.35 g, in the permanent magnets manufactured in an embodiment and in a comparative example, respectively. As shown in FIG. 9, it can be noted that the permanent magnet of the embodiment has been densely sintered into a cylindrical shape, without causing deformation such as warp or depression, even with the larger amount loaded to the die unit 46. That is, it can be noted that, in the embodiment, part of the formed body has flowed into the inflow hole 50 formed in the upper punch 48 or the lower punch 49 at spark plasma sintering, preventing pressure to the formed body from becoming higher than necessary.

In contrast, it can also be noted that in the permanent magnet of the comparative example, due to the larger loaded amount, the pressure at spark plasma sintering has become higher than necessary, causing deficiencies in an outer shell portion.

FIG. 10 is a table illustrating a comparison result of shapes of a plurality of permanent magnets manufactured in the embodiment and in the comparative example, respectively. Further, FIG. 11 is a table relating to a comparison of shape variations (reflected in specific gravities) of a plurality of permanent magnets simultaneously manufactured in the embodiment.

As illustrated in FIG. 10, in the embodiment where sintering has been performed by the SPS apparatus 45 having the inflow hole 50, no significant shape variation has occurred in a plurality of sintered permanent magnets. Specifically, as illustrated in FIG. 11, regardless of a slight difference of the amounts loaded into the die units, the sintered permanent magnets have no significant difference in specific gravity, which indicates that the magnets have been densely sintered. That is, it can be observed in the embodiment, at the spark plasma sintering, the partial flow of the formed body in the inflow hole 50 formed in the upper punch 48 or the lower punch 49 has helped the formed body to attain uniformity in shape or density.

In contrast, in the comparative example where sintering has been performed by the SPS apparatus 45 having no inflow hole 50, significant shape variation has occurred among the plurality of sintered permanent magnets.

As described in the above, according to the permanent magnet 1, the method and the system for manufacturing the permanent magnet 1 directed to the embodiment, magnet material is milled into magnet powder, the milled magnet powder is formed, and the formed body of the formed magnet powder is calcined, and thereafter, is sintered by spark plasma sintering using the SPS apparatus 45 to produce the permanent magnet 1. Further, the die unit 46 of the SPS apparatus 45 has, at least in one direction, the inflow hole 50 configured to receive inflow of part of the pressurized formed body 40. As a result, shape uniformity of respective permanent magnets 1 can be improved in mass-producing permanent magnets 1 of an identical shape. In addition, improvement in production efficiency can be achieved through eliminating the need of correction processing after sintering.

Specifically, even if there is a variation in an amount loaded in a die unit 46 of the SPS apparatus 45, shape uniformity of permanent magnets 1 can be secured. Further, even if an excessive amount is loaded in a die unit 46, there is no possibility that a pressure value becomes higher than necessary, and no deficiencies may occur at sintering.

The SPS apparatus 45 is equipped with a plurality of die units 46, and simultaneously sinters a plurality of formed bodies 40 by pressure sintering. As a result, further improvement in production efficiency can be attained. Shape variation in the simultaneously sintered permanent magnets can also be prevented.

The inflow hole 50 is a hole with a diameter of 1 mm-5 mm. The inflow hole 50 having an appropriate shape can facilitate a proper pressure-sintering operation, and also can help maintain an effect of shape uniformity in the sintered permanent magnets.

The inflow hole 50 is formed in a surface vertical to a direction of pressure at the pressure-sintering, enabling further improvement of the effect of shape uniformity, and ensuring easy removal of the sintered permanent magnet from the die unit.

Further, in the step of pressure sintering the formed body 40, the formed body 40 is sintered by uniaxial pressure sintering. The uniaxial pressure sintering helps the permanent magnet to contract uniformly at the sintering, which enables prevention of deformations such as warpage and depressions in the sintered permanent magnet.

Further, in the step of pressure sintering the formed body 40, the formed body 40 is sintered by electric current sintering. Thereby, heating or cooling of the formed body can be quicker, and the formed body can be sintered in a lower temperature range. As a result, the heating-up and holding periods in the sintering step can be shortened; so that a densely sintered body can be manufactured in which grain growth of the magnet particle is suppressed.

Further, the permanent magnet is produced by mixing magnet powder and a binder and forming the mixture to obtain a green sheet, and sintering the green sheet. The use of the green sheet helps uniform contraction and enables prevention of deformations such as warpage and depressions in the sintered permanent magnet. Also, the use of the green sheet helps prevent uneven pressure at pressurization and eliminates the need of correction processing which has been conventionally performed after sintering, to simplify the manufacturing steps. Thereby, a permanent magnet can be manufactured with dimensional accuracy. Further improvement of the effect of shape uniformity in the sintered permanent magnets can be achieved by the combined implementation of the green sheet with the sintering by the pressure sintering apparatus having the inflow hole.

It is to be understood that the present invention is not limited to the embodiments described above, but may be variously improved and modified without departing from the scope of the present invention.

Further, milling condition for magnet powder, mixing condition, calcination condition, sintering condition, etc. are not restricted to conditions described in the embodiments. For instance, in the above described embodiments, magnet material is wet-milled by using a bead mill. Alternatively, magnet material may be dry-milled by using a jet mill. For instance, in the above described embodiments, the green sheet is formed in accordance with a slot-die system. However, a green sheet may be formed in accordance with other system or molding (e.g., calender roll system, comma coating system, extruding system, injection molding, die casting, doctor blade system, etc.). Further, magnet powder and a binder may be mixed with an organic solvent to prepare slurry and the prepared slurry may be formed into a sheet-like shape to produce the green sheet. In such a case, a binder other than a thermoplastic resin can be used. The calcination may be performed under an atmosphere other than hydrogen atmosphere, as long as it is a non-oxidizing atmosphere (for instance, nitrogen atmosphere, helium atmosphere, or argon atmosphere).

Further, the calcination process may be omitted. Even so, the binder is thermally decomposed during the sintering process and certain extent of decarbonization effect can be expected.

Although resin, long-chain hydrocarbon, and fatty acid methyl ester are mentioned as examples of binder in the embodiments, other materials may be used.

Further, the permanent magnet can be manufactured through calcining and sintering a formed body formed by a method other than a method that forms a green sheet (for instance, powder compaction). Even in such a case, the pressure sintering can facilitate the improvement of shape uniformity.

Further, in the above embodiments, heating and magnetic field orientation of the green sheet 14 are simultaneously performed; however, the magnetic field orientation may be performed after heating and before solidifying the green sheet 14. Further, if the magnetic field orientation is performed before the formed green sheet 14 solidifies (that is, performed on the green sheet 14 in a softened state without the heating process), the heating process may be omitted.

Further, in the above embodiments, a slot-die coating process, a heating process and a magnetic field orientation process are performed consecutively. However, these processes need not be consecutive. Alternatively, the processes can be divided into two parts: the first part up to the slot-die coating process and the second part from the heating process and the processes that follow, and each of the two parts is performed consecutively. In such a case, the formed green sheet 14 may be cut at a predetermined length, and the green sheet 14 in a stationary state may be heated and exposed to the magnetic field for the magnetic field orientation.

Description of the present invention has been given by taking the example of the Nd—Fe—B-based magnet. However, other kinds of magnets may be used (for instance, cobalt magnet, alnico magnet, ferrite magnet, etc.). Further, in the alloy composition of the magnet in the embodiments of the present invention, the proportion of the Nd component is larger than that in the stoichiometric composition. However, the proportion of the Nd component may be the same as in the stoichiometric composition. Further, the present invention can be applied not only to anisotropic magnet but also to isotropic magnet. In the case of the isotropic magnet, the magnetic field orientation process for the green sheet 14 can be omitted.

DESCRIPTION OF REFERENCE NUMERALS AND SIGNS

1 permanent magnet
11 bead mill
12 mixture
13 supporting base
14 green sheet
15 slot die
25 solenoid

26 hot plate
37 heating device
40 formed body
45 spark plasma sintering (SPS) apparatus
46 die unit
47 die
48 upper punch
49 lower punch
50 inflow hole

The invention claimed is:

1. A method for manufacturing a rare-earth permanent magnet comprising steps of:

milling magnet material into magnet powder;

forming the magnet powder into a formed body;

arranging the formed body in a die unit of a pressure sintering apparatus; and sintering the formed body arranged in the die unit of the pressure sintering apparatus by pressure-sintering, and at the time of pressure-sintering, a part of the formed body is flowed into an inflow hole, wherein the die unit of the pressure sintering apparatus comprises, at least in one direction, the inflow hole, wherein the pressure sintering apparatus comprises a plurality of die units, and wherein the pressure sintering apparatus is configured to sinter a plurality of formed bodies simultaneously by the pressure-sintering.

2. The method for manufacturing a rare-earth permanent magnet according to claim 1, wherein the inflow hole is a hole with a diameter of 1 mm-5 mm.

3. The method for manufacturing a rare-earth permanent magnet according to claim 1, wherein the inflow hole is formed in a surface that is vertical to a direction of pressure at the pressure-sintering.

4. The method for manufacturing a rare-earth permanent magnet according to claim 1, wherein, in the step of sintering the formed body by the pressure-sintering, the formed body is sintered by uniaxial pressure sintering.

5. The method for manufacturing a rare-earth permanent magnet according to claim 1, wherein, in the step of sintering the formed body by the pressure-sintering, the formed body is sintered by electric current sintering.

6. The method for manufacturing a rare-earth permanent magnet according to claim 1, wherein, in the step of forming the magnet powder into the formed body, the magnet powder is mixed with a binder to prepare a mixture, and the mixture is formed into a sheet shape to produce a green sheet as the formed body.

* * * * *